US005377398A

United States Patent [19]

Bessey

[11] Patent Number: 5,377,398

[45] Date of Patent: Jan. 3, 1995

[54] METHOD FOR DESCALING METAL STRIP UTILIZING ANHYDROUS SALT

[75] Inventor: Charles M. Bessey, Plymouth, Mich.

[73] Assignee: Kolene Corporation, Detroit, Mich.

[21] Appl. No.: 44,946

[22] Filed: Apr. 8, 1993

Related U.S. Application Data

[63] Continuation-in-part of Ser. No. 926,528, Aug. 5, 1992, Pat. No. 5,272,798.

[51] Int. Cl.[6] ..... B23P 9/00; C23F 4/00

[52] U.S. Cl. ..... 29/81.07; 134/41; 148/242; 148/631; 252/80

[58] Field of Search ..... 29/81.01, 81.06, 81.07, 29/81.09; 134/2, 4, 41; 148/242, 631; 252/79.5, 80, 87, 49.3

[56] References Cited

U.S. PATENT DOCUMENTS 2,630,393 3/1953 Francis ..... 134/3
4,055,446 10/1977 Kunst et al. ..... 148/631
4,448,611 5/1984 Grellet et al. ..... 148/242
5,221,358 6/1993 Malloy ..... 252/80 X

*Primary Examiner*—Timothy V. Eley
*Assistant Examiner*—Khan V. Nguyen
*Attorney, Agent, or Firm*—Calfee, Halter & Griswold

[57] ABSTRACT

An improved salt and method of using such salt for conditioning scale on strip or sheet metal surfaces is provided. In more particular aspects, the invention provides an improved salt of alkali metal hydroxides and alkali metal nitrates which are used in their fused anhydrous form to condition scale on metal strip or sheet. The salt preferably contains from about 40% to about 70% potassium hydroxide, from about 20% to about 55% sodium hydroxide, and from about 2% to about 30% of an alkali metal nitrate. The salt is especially adapted to be sprayed onto a moving strip or sheet of metal as it passes a spray station, although it can also be used in conventional salt bath applications in which the salt is maintained in a fused condition in a tank, and the sheet, strip, bar, tubing or other form to be treated is immersed in the fused salt bath.

6 Claims, 5 Drawing Sheets

METHOD FOR DESCALING METAL STRIP UTILIZING ANHYDROUS SALT

RELATED APPLICATIONS

This is a Continuation-in-Part of application Ser. No. 07/926,528, Filed Aug. 5, 1992, for Method and apparatus for descaling Metal Strip, now U.S. Pat. No. 5,272,798.

FIELD OF THE INVENTION

The present invention relates generally to a method and salt for descaling metal strip or sheet, and more particularly to an improved Alkali Metal Hydroxide and Alkali Metal nitrate salt used in the fused anhydrous form to condition scale on metal strip or sheet.

BACKGROUND OF THE INVENTION

Various methods are known for descaling hot metal strip (or sheet) in a continuous annealing line of a production facility. One method for descaling metal strip is generally referred to as "fused alkali treatment", in which the undesired oxide coatings on the exterior surfaces, which are formed during the rolling or annealing procedures, are removed using fused (or molten) alkali salts for the purpose of improving the strip surface either for further processing, or as an end product. To complete the descaling, the metal strip is further processed, such as for example, by rinsing, quenching, and/or immersion for a short period of time in an acid bath (i.e., "acid pickling"). The fused alkali treatment can be used to descale a variety of alloys of metal strip, such as stainless steel, nickel, cobalt and titanium alloys.

Various types of apparatus have been proposed in the industry for effecting this descaling process. For example, an immersion tank is used wherein metal strip is immersed in a bath of mixed alkali metal hydroxides or salts. To guide the strip into and out of the molten bath, metal rolls typically are used to support the metal strip. Using metal rolls, however, can scratch and mar the surface of the strip through the presence of insoluble particles on the strip and/or the relative movement between the hot strip and the rolls.

Additionally, an immersion tank requires a considerable amount of space in the processing line of the production facility. Further, it has been determined that the descaling salts interact rather quickly with the scale on the strip, in fact typically quicker than the time it takes the steel to travel through the bath. Hence, using an immersion tank to descale a metal strip in a continuous annealing line can be inefficient by "overconditioning" the strip with excessive salt contact. Overconditioning the surface of the strip can make it more difficult to clean the strip in the subsequent acid pickling.

Methods and apparatus have been developed where descaling salts are applied directly to the metal strip in a spray after the strip leaves the annealing furnace. Spray systems generally reduce overconditioning of the strip and can have a scale loosening, scouring or scrubbing action which facilitates oxidizing the scale. For example, one technique is shown in Faler, U.S. Pat. Nos. 3,126,301 and 3,174,491, both of which are owned by the assignee of the present invention, wherein the metal strip is supported by tension through the descaling system. The molten salt in Faler is atomized within a spray box using large quantities of a gas, such as superheated steam. The steam is passed into nozzles through which is fed small quantities of the molten salts. The nozzles for applying the atomized salt are illustrated as being located centrally of the strip and directed toward opposite surfaces thereof. Steam is also provided through steam nozzles into the atmosphere of the oven for a general heating of the atmosphere to prevent any non-atomized salt from solidifying and contacting the strip.

Another method for descaling metal strip is shown in Hirata, et al, U.S. Pat. No. 4,251,956, in which a descaling slurry is applied to a surface of the strip from a nozzle array. The nozzle array comprises four sets of nozzles mounted between a supporting column and a connecting rod. The nozzle array is positioned in spaced relation to the strip surface and is directed toward the strip surface at an acute spray angle relative to the direction of movement of the strip.

Still other spray descaling systems using a plurality of nozzles located across the width of the strip are shown in McClanahan, et al, U.S. Pat. No. 4,361,444, and Hiroshima, U.S. Pat. No. 3,617,039.

Although the above-described descaling systems provide certain benefits in spraying salt across the surfaces of the metal strip for descaling, as well as reducing or eliminating metal rolls contacting the strip, these systems are not without drawbacks. For example, some of these systems require a large array of nozzles which are located at various orientations relative to the surfaces of the strip, such as shown in Hirata. However, providing a large array of nozzles increases the over-all cost of the descaling system, as well as increases the possibility that one or more of the nozzles will become damaged or clogged.

Moreover, none of the previous descaling systems provide nozzles which can be simply and easily removed from the descaling system, inspected, and repaired or replaced if necessary. As indicated above, the nozzles can have a tendency to become damaged or clogged when used over long periods of time, and it is sometimes necessary to access the nozzles (and related equipment such as pumps and heaters), such that repair or replacement can be made. However, when nozzles are connected to pipes mounted over and traversing the metal strip (such as shown in Hirata), access to the nozzles can be limited and difficult.

In any case, there is a constant demand in the industry for descaling systems which effectively and efficiently descale metal strip in a continuous annealing line of a production facility.

SUMMARY OF THE INVENTION

The present invention provides an improved salt and method of using such salt for conditioning scale on strip or sheet metal surfaces. In more particular aspects the invention provides an improved salt of alkali metal hydroxides and alkali metal nitrates which are used in their fused anhydrous form to condition scale on metal strip or sheet. The salt contains from about 40% to about 70% potassium hydroxide, from about 20% to about 55% sodium hydroxide, and from about 2% to about 30% of an alkali metal nitrate. More preferably, the salt contains from about 45% to about 60% potassium hydroxide, from about 25% to about 45% sodium hydroxide, and from about 6% to about 20% of an alkali metal nitrate. More specifically, the most preferred embodiment contains a eutectic ratio of potassium hydroxide and sodium hydroxide with about 10% of an alkali metal nitrate, preferably sodium nitrate. The salt is especially adapted to be sprayed onto a moving strip or sheet of metal as it passes a spray station, although it can also be used in conventional salt bath applications in which the salt is maintained in a fused condition in a tank, and the strip, sheet, tubing, bars or other shapes to be treated are immersed in the fused salt bath.

DETAILED DESCRIPTION OF THE PREFERRED EMBODIMENT

Figure 1:
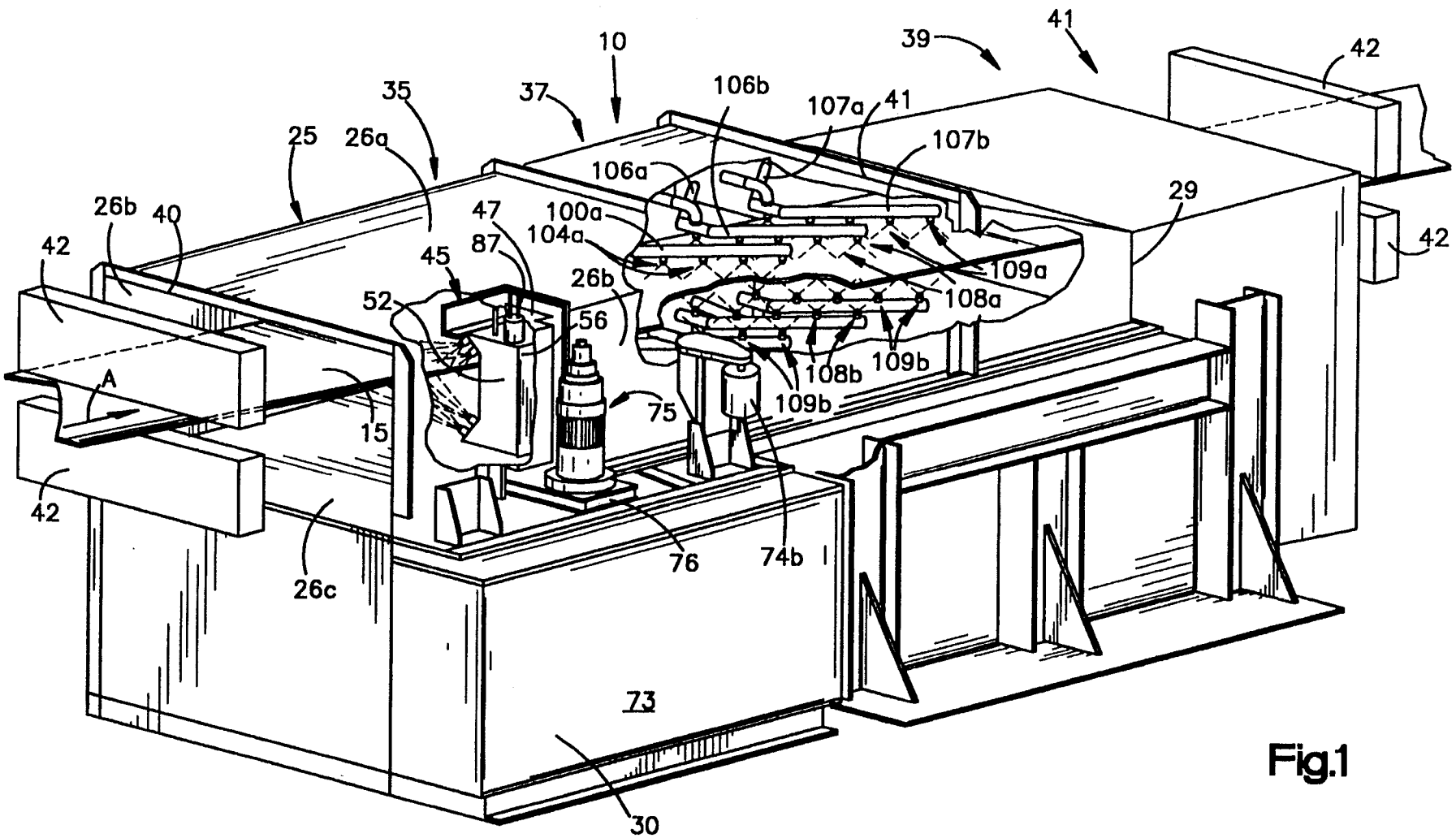
FIG. 1 is a perspective view somewhat diagrammatic of the spray descaling system constructed according to the principles of the present invention with portions shown cut-away.
Figure 2:
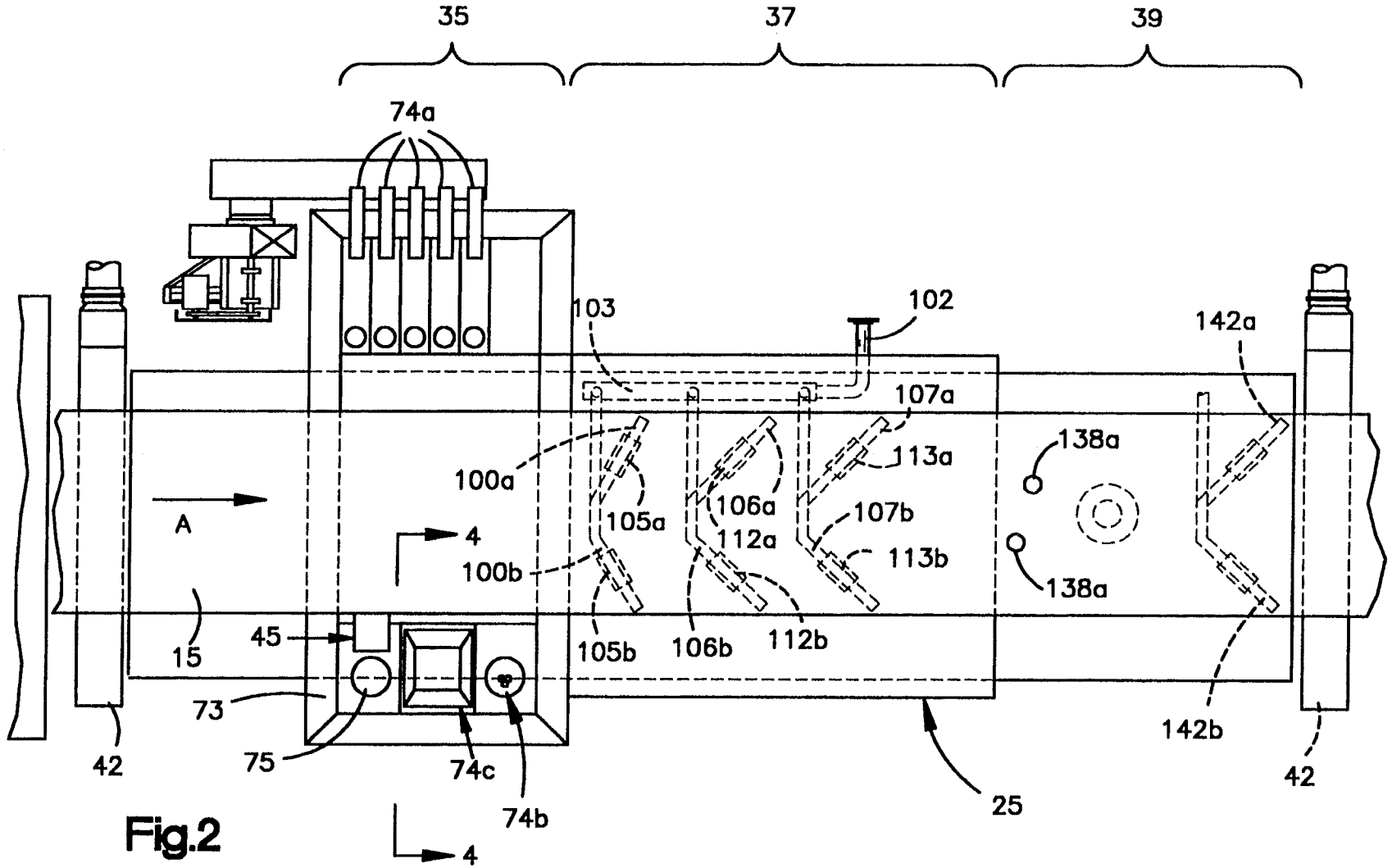
FIG. 2 is a top plan schematic illustration of the spray descaling system of FIG. 1.
Figure 3:
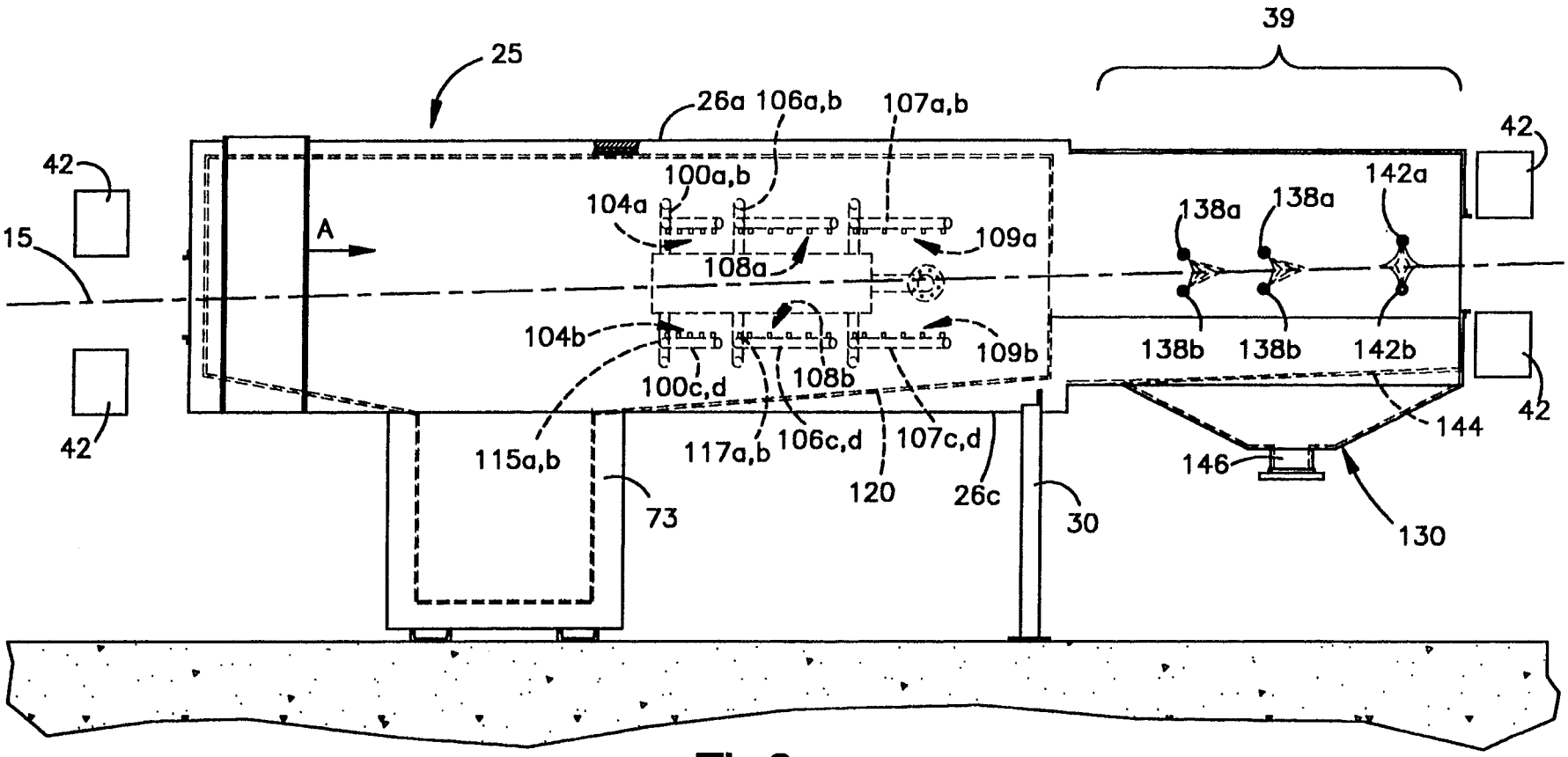
FIG. 3 is a side elevational schematic illustration of the spray descaling system of FIG. 2.

Referring to the drawings, and initially to FIGS. 1–3, a spray descaling system is illustrated generally at 10, wherein hot metal strip 15 emerges at a predetermined speed from an annealing furnace (not shown) having an output temperature of approximately 2050° F. (1121° C.) in the processing line of a production facility. The hot metal strip 15 typically then enters a cooler section wherein the strip is cooled to a temperature of between about 1000° F. (538° C.) and 1200° F. (650° C.) for an alloy such as stainless steel. However, as will become apparent upon reading the following specification, the present invention can be equally applicable to metal strip (or sheet) formed of other alloys (e.g., titanium, nickel or cobalt) which develop oxide coatings on the surface during annealing or other processing. The temperature to which these alloys are cooled might be slightly different than indicated above.

The metal strip from the cooler section passes through a spray box, indicated generally at 25, in the spray descaling system at the pass line height of the annealing furnace in the direction labeled "A". The strip can be supported by rolls or rollers (not shown) located remote from the spray box, but is preferably supported by tension through the spray box. As the strip enters the spray box, the strip has cooled to a temperature of between about 1000° F. (538° C.) and 1200° F. (650° C.).

The spray box 25 for the spray descaling system comprises a box-like, insulated structure having steel top wall **26*a*, side walls 26*b* and bottom wall 26*c* welded at the corners and supported on a frame or support structure 30. The spray box and frame are constructed using conventional welding and fabricating techniques and materials. The spray box includes a spray area, indicated generally at 35, a steam wipe area, indicated generally at 37, and a rinse area (both water and air blow-off), indicated generally at 39. The strip enters the spray box from the cooler section through opening 40, and exits through opening 41 (FIG. 1) to be further processed, for example in an acid pickling bath. To prevent any salt spray escaping from the spray box to the surrounding environment, vacuum boxes 42** can be mounted at the entrance and exit of the spray box both above and below the metal strip to collect the escaping salt spray.

Figure 4:
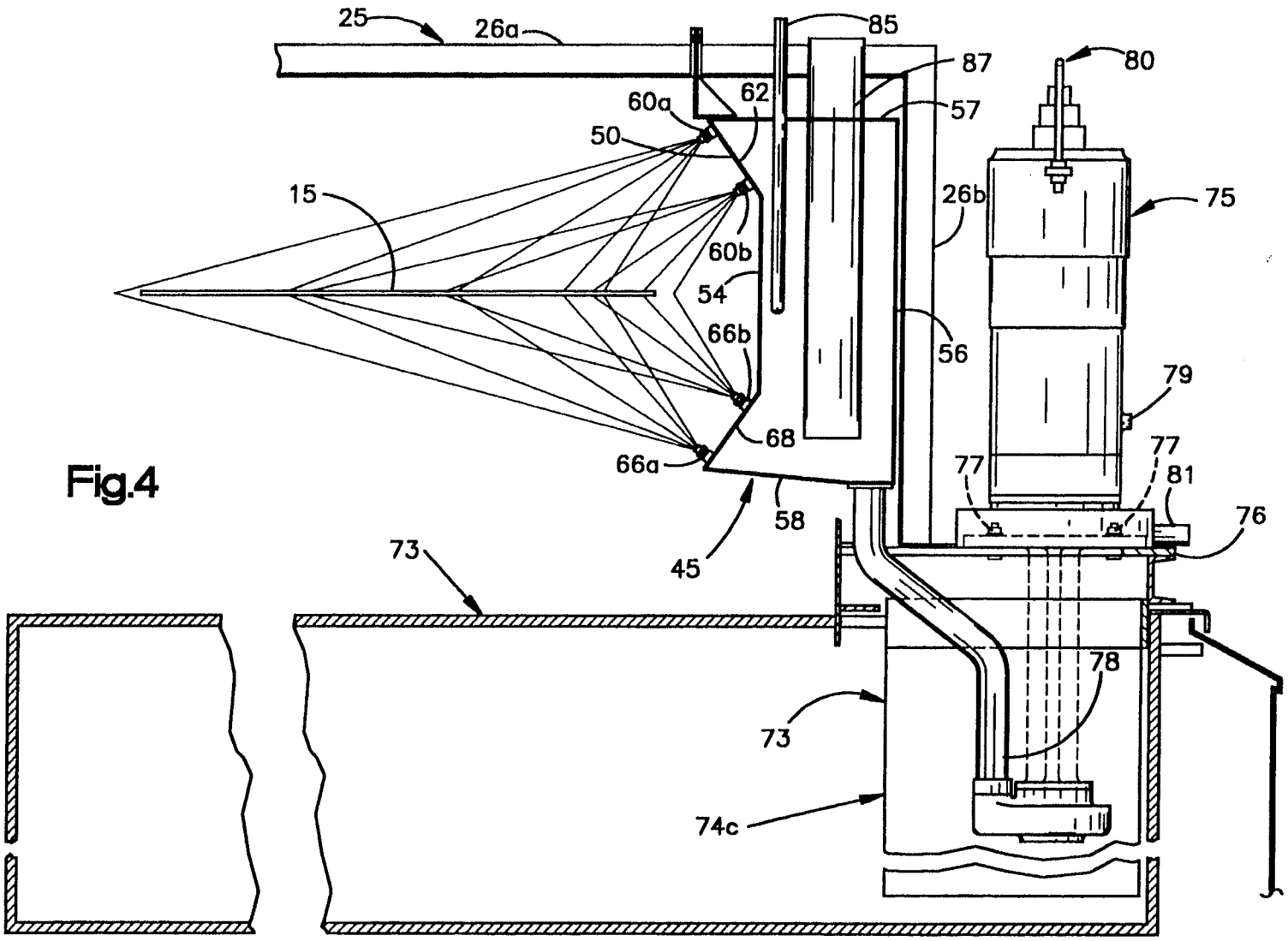
FIG. 4 is an enlarged, cross-sectional front view of the spray box taken substantially along the plane designated by the line 4—4 of FIG. 2.

Molten salt is applied to the metal strip to descale the strip in the spray area 35 of the spray box. To this end, a nozzle assembly, indicated generally at 45, is mounted within an aperture 47 formed in the side wall **26*b* of the spray box 25. As shown in detail in FIG. 4, the nozzle assembly 45 comprises a self-contained unit having a spray chamber 50 with side walls 52 (FIG. 1), front wall 54 and rear wall 56, which, along with top wall 57 and bottom wall 58**, form a fluid-tight enclosure. The walls are welded or otherwise attached together along the edges and are preferably formed from material which is non-reactive with the molten salt, but which conducts heat evenly throughout, such as nickel, or nickel-based alloys.

The nozzle assembly 45 further includes an array of nozzles which are mounted directly to the front wall 54 of the spray chamber 52. In particular, the nozzle array includes an upper pair of nozzles 60A, 60B, mounted to an upper angled portion 62 of the front wall 54; and a lower pair of nozzles 66A, 66B, mounted to a lower angled portion 68 of the front wall 54. The upper and lower angled portions 62, 64 are formed such that the nozzles 60A, 60B and 66A, 66B are directed downwardly and upwardly, respectively, toward the metal strip 15 at a predetermined angle.

Preferably, the nozzles are directed at approximately a 55° angle (measured from the plane of the strip) toward the upper and lower surfaces, respectively, of the metal strip such that molten salt sprayed through the nozzles impinges upon and completely covers the upper and lower surfaces of the strip. The value of the specific angles is not critical other than to position the nozzles 60A, 60B, 66A, 66B to spray the salt across the entire upper and lower surface of the strip as will be described herein. The nozzles are mounted on the spray chamber towards one side of the strip and direct the spray transversely across the strip as the strip moves through the spray box.

The nozzles 60A, 60B and 66A, 66B are preferably formed from metal or other heat conductive material and are in heat-exchange (i.e., conductive) relationship with the front wall of the spray chamber. The nozzles are preferably flat, fan-type hydraulic nozzles which spray the molten descaling salt across the surfaces of the metal strip; however, it is also within the scope of the invention to use other conventional nozzle-type devices, including openings or apertures in a pipe, to apply the molten descaling salt in a continuous stream against the surfaces of the metal strip. All such nozzle-type devices will be generally referred to hereinafter as "nozzle device".

The salt is supplied from a remote source such as a tankwagon or other storage facility (not shown) to a salt furnace, indicated generally at 73. The salt is preferably spray-added into the salt furnace using the techniques described in Wood et al, U.S. Pat. No. 4,455,251 and Shoemaker et al, U.S. Pat. No. 4,113,511, both of which are owned by the assignee of the present invention, and which are incorporated herein by reference. The salt is maintained in the salt furnace in a molten state (approximately 500° F. (260° C.) to 1100° F. (593° C.)). The salt furnace can include a heating device (e.g., burner tubes **74*a* immersed in the salt), agitator 74*b* to continuously circulate the molten salt, and screens, filters and/or a sludge pan, indicated schematically at 74*c* in FIG. 2**, to filter out undesirable impurities in the salt.

The molten salt is pumped from the salt furnace 73 to the spray chamber 50 for spraying on the metal strip. To this end, an immersion pump, preferably operated with a variable speed motor indicated generally at 75, is mounted on a platform 76 along the side of the spray box 25 and attached thereto with fasteners such as bolts 77. The immersion pump is conventional in design and designed to operate in high temperature, corrosive situations. The immersion pump preferably operates at 5 gpm at 26 ft. head to draw the molten salt from the salt furnace 73 and force the molten salt through pipe or conduit 78 into an opening (not numbered) in the bottom of the salt spray chamber. The pump includes a cooling water inlet 79 and outlet 80 to circulate water to cool the pump during use. A preferred pump of the type just described is manufactured by the Gusher Pump Company.

The salt in the spray chamber is maintained in its molten state by a control system including a heater 87 (e.g., an electric resistance or gas-fired heater) which extends through an opening formed in the top wall 57 of the spray chamber and is in direct contact with the portion of the spray chamber surrounding the opening. When the heater 87 is activated, the heater maintains the salt within the spray chamber at a temperature above its melting point, and preferably at a temperature of between 500° F. (260° C.) and 1100° F. (593° C.). The heater also heats the walls of the spray chamber by conduction through direct contact, by convection through heating of the molten salt in the spray chamber, and by radiation. The control system also includes a thermocouple 85 which can be mounted to and extend into the spray chamber to sense the temperature of the empty chamber or molten salt within the spray chamber and periodically activate the heater 87 when necessary, and a timer (not shown).

Additionally, since the nozzles are mounted directly to the spray chamber, the nozzles are also heated by the heater by conduction through the walls of the spray chamber. The nozzles are also preferably maintained at a temperature above the melting point of the salt, and preferably at a temperature of approximately 900° F. (482° C.), to prevent the salt from clogging the nozzles during the spray process, particularly when the salt is initially pumped into the spray chamber.

In fact, prior to the immersion pump supplying the molten salt to the spray chamber, a "preheating" function is performed for the salt descaling system. More particularly, the heater 87 is activated until a predetermined temperature above the melting point of the salt is obtained in the spray chamber. Preheating the chamber prevents salt from initially "freezing" on the walls of the chamber when the pump is activated and the salt is introduced into the chamber. The nozzles are also preheated in this manner above the melting point of the salt by conduction through the spray chamber. Preheating the nozzles also prevents the salt from initially clogging the nozzles.

In operation, the spray chamber and nozzles are initially preheated above the melting point of the salt as described above. The molten salt in the salt furnace is then supplied to the spray chamber by the immersion pump. The molten salt fills the spray chamber and flows out through the nozzles in a spray. The molten salt is applied through the nozzles at a low pressure (approximately 5 psi) as the immersion pump operates. The nozzles spray the molten salt on the strip to essentially cover the upper and lower surfaces of the strip. Moreover, the angle at which the nozzles direct the molten salt toward the strip, and the location of the nozzles on the side of the strip properly distribute the salt across the upper and lower surfaces of the strip. When the spraying process is complete, the immersion pump is turned off, and the salt is allowed to drain out of the nozzles and the salt chamber into the salt furnace before the heater is deactivated.

The nozzle assembly 45 is removable mounted within the opening 47 formed in the side of the spray box. Flanges can be formed on one or both of the spray chamber and the spray box such that the nozzle assembly 45 can be mounted thereto with fasteners (e.g., nuts and bolts). When it is necessary or desirable to remove the nozzle assembly, the bolts 77 mounting the immersion pump to the platform 76 are removed, and the nozzle assembly and immersion pump are withdrawn from the spray box. Since the nozzles are mounted directly to the spray chamber, removing the nozzle assembly from the spray box also removes the nozzles, and hence makes it simple and easy to inspect the spray nozzles and to repair or replace the nozzles (and/or other equipment such as the immersion pump, thermocouple or heater) should they become clogged, damaged or otherwise unusable. As an additional benefit, removing the immersion pump provides easy access to the salt furnace for inspection thereof.

It has been determined that the characteristics of time, strip and salt temperature, and salt quantity and composition are factors in determining the most efficient and effective process for spraying salt on the metal strip. In particular, for austenitic and ferritic stainless steel alloys, it has been determined that a reaction time of approximately one (1) second to one and one-half (1.5) seconds is preferred to provide proper descaling. However, it is believed that proper descaling can be achieved if the salt contacts the metal strip for periods of up to 5 seconds. The reaction time is determined by strip speed (typically 30 to 400 ft/min (9–120 m/min) and the distance between the salt spray and the steam wipes.

The reaction and reaction time are also dependent upon the strip temperature and the applied salt temperature. It has been determined that the strip temperature is the more important of the two because the mass of the steel strip is much greater than the mass of the applied salt. The lower temperature limit of the strip is about 900° F. (482° C.), which is determined by the reactivity of the salt with the surface of the metal strip, and is preferably about 1100° F. (593° C.) for a salt spray above 700° F. (371° C.) and about 1200° F. (649° C.) for salt spray below 700° F. (371° C.). The upper limit of the strip temperature is determined by the point where chemical overconditioning and distortion of the strip occurs when the hot, thin strip is rapidly cooled, and is typically about 1300 degrees F. (704° C.).

SALT COMPOSITION

The selection of the salt which is to be used is dependent on several factors. Of course a principal factor is the ability of the salt to effectively condition the scale i.e. descale the work piece in the time that it is in contact with the scale on the metal at a given temperature of the metal and at a given temperature of the salt. The salt must be aggressive enough to perform this function. However, the salt should not be so aggressive that it "over oxidizes" the scale at these given exposure temperatures and times. In this over oxidized condition the scale is more resistant to the subsequent pickling operation which ultimately removes the conditioned scale. Hence the salt should not be so aggressive at the selected times and temperatures to cause such a condition. Moreover, it is desirable for several reasons to have an effective salt with as low a melting point as possible. This improves the operation of the salt in the spraying apparatus, reduces energy costs in operating the system, lowers viscosity and subsequently reduces drag-out. Thus, all of these factors must be considered when selecting a salt for the spraying operation.

When used for descaling austenitic stainless steel (e.g., 304 and 316), and ferritic stainless steels (e.g. 409, 430) the molten salt for the descaling system is preferably a salt of sodium hydroxide and potassium hydroxide eutectic with about 10% by wt. of an alkali metal nitrate, preferably sodium nitrate. The hydroxide eutectic is a 50—50 mole ratio which is 58% by weight KOH and 42% by weight NaOH. It has been found that the salt of this invention has a very low melting point i.e. about 300° F. (149° C.). This salt effectively performs the descaling in 1.5 seconds or less, and it does not over oxidize the scale. However, other proportions of the hydroxides and alkali metal nitrates can be utilized but with some reduced effectiveness in certain aspects of the salt. Other salts, such as those manufactured by the assignee of the present invention under the trademarks "DGS" and "K6",can also be employed for the descaling. Table I below shows test results on selected samples using various commercially available salt compositions at different salt temperatures and different sample temperatures:

TABLE I

| Sample # | Salt Comp. | Salt Temp. | Sample Temp. | Results |
|---|---|---|---|---|
| 1 | DGS* | 900° F. | 1100° F. | at 1100° F., K-6 best |
| 2 | DGS* | 900° F. | 1300° F. | then DGS then |
| 3 | K-6** | 900° F. | 1100° F. | KOH. |
| 4 | K-6** | 900° F. | 1300° F. | at 1300° F., KOH |
| 5 | KOH | 900° F. | 1100° F. | best then K-6 then |
| 6 | KOH | 900° F. | 1300° F. | DGS. |
| 7 | DGS | 700° F. | 1100° F. | at 1100° F., K-6 best |
| 8 | DGS | 700° F. | 1300° F. | then KOH then |
| 9 | K-6 | 700° F. | 1100° F. | DGS. |
| 10 | K-6 | 700° F. | 1300° F. | at 1300° F., KOH |
| 11 | KOH | 700° F. (1) | 1100° F. | best then K-6 then |
| 12 | KOH | 700° F. (1) | 1300° F. | DGS. |

Of samples 1-12 all salts performed best at 700° F. salt temperature and 1100° F. strip temperature - of which K-6 was the best salt. At 1300° F., samples are all over oxidized.

All samples were 316 grade stainless steel panels which were cold rolled and annealed. Panels were heated to the indicated temperature and exposed to the salt at the indicated temperature for 1-1.5 seconds and then pickled in 5% $HNO_3$ - 1% HF at 130° F. for one second and 3 seconds and 4 seconds.

(1) Contained crystals from the onset of solidification

*DGS = 8% KOH, 65% NaOH, 15% $NaNO_3$, 12% NaCl

**K-6 = 61.5% KOH, 37.8% $NaNO_3$, 0.7% $KMNO_3$

The experiments listed in Table I show the results in descaling 300 series stainless steel with three commercially available salt compositions, i.e. DGS, K-6, and KOH. These experiments show that between KOH and NaOH based salts, KOH based salts appear to be more aggressive, as would be expected. While 100% KOH is very effective, even on the over oxidized higher temperature strip, it has limited application because of its higher melting point (716° F., increased viscosity and higher rates of drag-out.

Table II below gives the results of the evaluation of descaling of various samples of 316 type stainless steel, exposed for 1.5 seconds in several different salts at several different salt temperatures and sample temperatures. After the salt treatment, the samples were pickled in 5% $HNO_3$/1% HF @ 130° F. for 1 sec. 3 sec, and 4 sec. Surprisingly, the salt containing both anhydrous KOH and NaOH, in eutectic proportions with $KNO_3$ added performs better than salts with higher KOH% without NaOH even with a nitrate, especially at lower temperatures down to 500° F. Hence, of this group of salts, the salt of this invention designated as LN salt is the best, followed by the anhydrous Alko salt, designated SS, followed by K-6 salt. The DGS salt is reasonably effective, at higher strip temperatures and the necessarily higher salt temperatures (because of its higher melting point). The salt designated HN was largely ineffective.

TABLE II

| Salt Bath Comp. | Salt Bath Temp. | Strip Temp. | Results |
|---|---|---|---|
| DGS | 600° F. | 900 | not reacted |
| | | 1000 | not reacted |
| | | 1100 | incomplete reaction |
| DGS | 700° F. | 900 | not reacted |
| | | 1000 | not reacted |
| | | 1100 | incomplete reaction (even with 10 sec. immersion) |
| | | 1200 | incomplete reaction, but better than 1100 |
| DGS | 800° F. | 1000 | incomplete reaction |
| | | 1100 | ok |
| DGS | 900° F. | 1000 | incomplete reaction |
| | | 1100 | excellent |
| DGS | 1000° F. | 900 | not reacted |
| | | 1000 | incomplete reaction |
| | | 1100 | ok; |
| | | 1100* | (over oxidized) |
| K-6 | 600° F. | 900 | not reacted |
| | | 1000 | incomplete reaction |
| | | 1100 | incomplete reaction |
| K-6 | 700° F. | 900 | not reacted |
| | | 1000 | incomplete reaction |
| | | 1100 | ok; |
| | | 1100* | slight over oxidation |
| K-6 | 800° F. | 1000 | incomplete reaction |
| | | 1100 | excellent |
| K-6 | 900° F. | 1000 | incomplete reaction |
| | | 1100 | excellent |
| K-6 | 1000° F. | 900 | not reacted |
| | | 1000 | incomplete reaction |
| | | 1100 | ok |
| SS | 600° F. | 900 | not reacted |
| | | 1000 | incomplete reaction |
| | | 1100 | ok |
| SS | 700° F. | 900 | incomplete reaction |
| | | 1000 | ok |
| | | 1100 | excellent; |
| | | 1100* | slight over oxidization - ok |
| SS | 800° F. | 1000 | ok |
| | | 1100 | excellent |
| SS | 900° F. | 1000 | excellent |
| | | 1100 | excellent; |
| | | 1100* | over oxidized |
| SS | 1000° F. | 900 | incomplete reaction |
| | | 1000 | incomplete reaction |
| | | 1100 | ok |
| LN | 500° F. | 1100 | ok |
| | | 1200 | excellent |
| LN | 600° F. | 1000 | incomplete reaction |
| | | 1100 | excellent |
| | | 1200 | excellent |
| LN | 700° F. | 1000 | incomplete reaction |
| | | 1100 | excellent |
| LN | 900° F. | 900 | incomplete reaction |
| | | 1000 | ok |
| | | 1100 | excellent |
| | | 1200 | excellent |
| HN | 500° F. | 1100 | incomplete reaction |
| | | 1200 | incomplete reaction |
| HN | 600° F. | 1000 | not reacted |
| | | 1100 | incomplete reaction |

TABLE II-continued

| Salt Bath Comp. | Salt Bath Temp. | Strip Temp. | Results |
|---|---|---|---|
| | | 1200 | incomplete reaction, but better |
| HN | 700° F. | 1000 | incomplete reaction |
| | | 1100 | incomplete reaction |
| HN | 900° F. | 900 | not reacted |
| | | 1000 | not reacted |
| | | 1100 | incomplete reaction |
| | | 1200 | incomplete reaction |

DGS 57% NaOH, 8% KOH, 15% $NaNO_3$, 12% NaCl
K-6 61.5% KOH, 37.8% $NaNO_3$; 0.7% $KMnO_4$
SS 83.3% KOH, 16.7% $KNO_3$
LN 53% KOH, 37% $NaNO_3$, 10% $KNO_3$
HN 60% $KNO_3$, 40% KOH
*With 10 seconds exposure to salt
Rating:
not reacted = little or no salt effect
incomplete reaction = some effect but not enough conversion
ok = complete salt conversion, but not as good as excellent
excellent = complete scale conversion, minimum acid use The melting points of the various salts are as follows:
DGS~525° F.
K-6~394° F.
LN~300° F.
SS~640° F. (anhydrous)
HN~450° .
KOH/NaOH eutectic~338° F.
KOH (anhydrous)~716° F.

As indicated above, it is desirable to have as low a melting point salt as is possible for reduced viscosity and drag-out, but which will effectively perform the descaling over a broad operational temperature range (500° F. to 1100° F.). The eutectic ratio of KOH/NaOH with the addition of a nitrate is thus the most effective of these salts.

Table III below shows various other compositions of salt baths used to test their scale conditioning i.e. descaling properties on 316 grade stainless steel panels. These steel samples were preheated to 1100° F. In each case, the salt was heated to 1000° F. to dehydrate the bath and then cooled to 700° F. and 600° F. The steel samples were treated at both temperatures and the composite evaluation is given in Table 3.

TABLE III

| | | |
|---|---|---|
| A | 57% KOH (anhydrous)<br>41% NaOH<br>2% $KMNO_4$ | Little salt effect |
| $A_1$ | added 2% $KNO_3$ to above A | Some effect |
| $A_2$ | added 4% $KNO_3$ to above $A_1$ | Better than $A_1$ |
| B | 53% KOH (anhydrous)<br>37% NaOH<br>10% $KNO_3$ | Clean (good) |
| $B_1$ | added 5% KF to above B | slightly better than B |
| $B_2$ | added 1% $KMnO_4$ to above $B_1$ | not as good as $B_1$ |
| C | 53% KOH (anhydrous)<br>37% NaOH<br>10% $NaNO_3$ | clean (good) |
| $C_1$ | added 5% $Na_2B_4O_7$ (anhydrous) - to above C | slightly better than C |
| $C_2$ | added 1% $KMnO_4$ to above $C_1$ | not as good as $C_1$ or $B_2$ |
| D | 57% KOH - 2280 g (anhydrous)<br>41% NaOH - 1640 g<br>2% $KNO_3$ - 80 g | clean (ok) (not as good as B or C) |
| $D_1$ | added 0.5% $KMnO_4$ to above D | not as good as D |
| $D_2$ | added 2% NaF to above $D_1$ | same as $D_1$ |
| $D_3$ | added 2% $Na_2B_4O_7$ to above $D_2$ | not as good as $D_2$ |
| $D_4$ | added 8% $KNO_3$ to above $D_3$ | clean |

All panels treated as previously (Table I), i.e. 1-1.5 sec. in salt, rinse and then pickle in $HNO_3$/HF at 130° F. for 1 second and 3 seconds and 4 seconds.

(It should be noted that Commercial grade KOH contains about 10% water ($H_2O$) which can have a significant effect on salt formulas containing KOH.)

With salts A, B, C, and D, the bath was slowly brought up to 500° F. to retain as much water as possible at this temperature (about 10%). The test panels were preheated to 1200° F. The panels were treated as described in Table I in each salt bath at 500° F., and then the baths were raised to 600° F. and additional panels were treated as described in Table I. All of the baths were then raised to a temperature of 1000° F. to drive off the water and thus form an essentially anhydrous bath. The temperatures of the baths were then lowered and sample panels processed at 500° F. and 600° F. bath temperatures with the panels at 1200° F. The panels that were treated in the baths that had not first been heated to 1000° F. to drive off essentially all of the water had significantly worse results in scale conditioning (i.e. descaling) than those treated at the same temperatures after the bath had been heated to 1000° F. to drive off the water. Hence, it is strongly preferred that the fused salt be essentially anhydrous when used for descaling. Since commercial grade KOH contains about 10% water, in order to make it essentially anhydrous it should be heated to at least about 700° F. or higher (depending upon time at temperature) to drive off the water, thus achieving an essentially anhydrous salt bath.

These results indicate that $NaNO_3$ and $KNO_3$ additions to eutectic ratio NaOH/KOH are relatively comparable in descaling (see samples B and C), and that the addition of permanganates, fluorides, and borate do not noticeably increase the effectiveness of the salt (see samples $B_1$, $B_2$, $C_1$ and $C_2$). The tests also indicate that even at a 2% level the addition of an alkali metal nitrate provides significant beneficial effects over a KOH/NaOH eutectic alone (cf. samples A and D). These tests also indicated that the salts should be essentially anhydrous when they are being used. These tests also showed the detrimental effect of $KMnO_4$. Those salts having $KMnO_4$ performed significantly less effectively than comparable salts without $KMnO_4$. For example, compare salt A to salt D, salt $B_2$ to Salt $B_1$ and salt $C_2$ to salt $C_1$. Thus it is believed that salt $A_2$ without the $KMnO_4$ would be more effective than salt D.

Tests were performed using baths having NaOH/KOH eutectic ratio with sodium nitrate additions equal to 10%, 20%, 30% and 40% of the total bath weight. There was not a great deal of difference between the descaling effectiveness of the salts with varying nitrate concentrations, although higher nitrate does tend to slightly overoxidize the scale and raise the melting point of the salt. However, pickling will readily remove even this overoxidized or overconditioned scale. Hence from about 10% to about 20% of an alkali metal nitrate is preferred.

Figure 5:
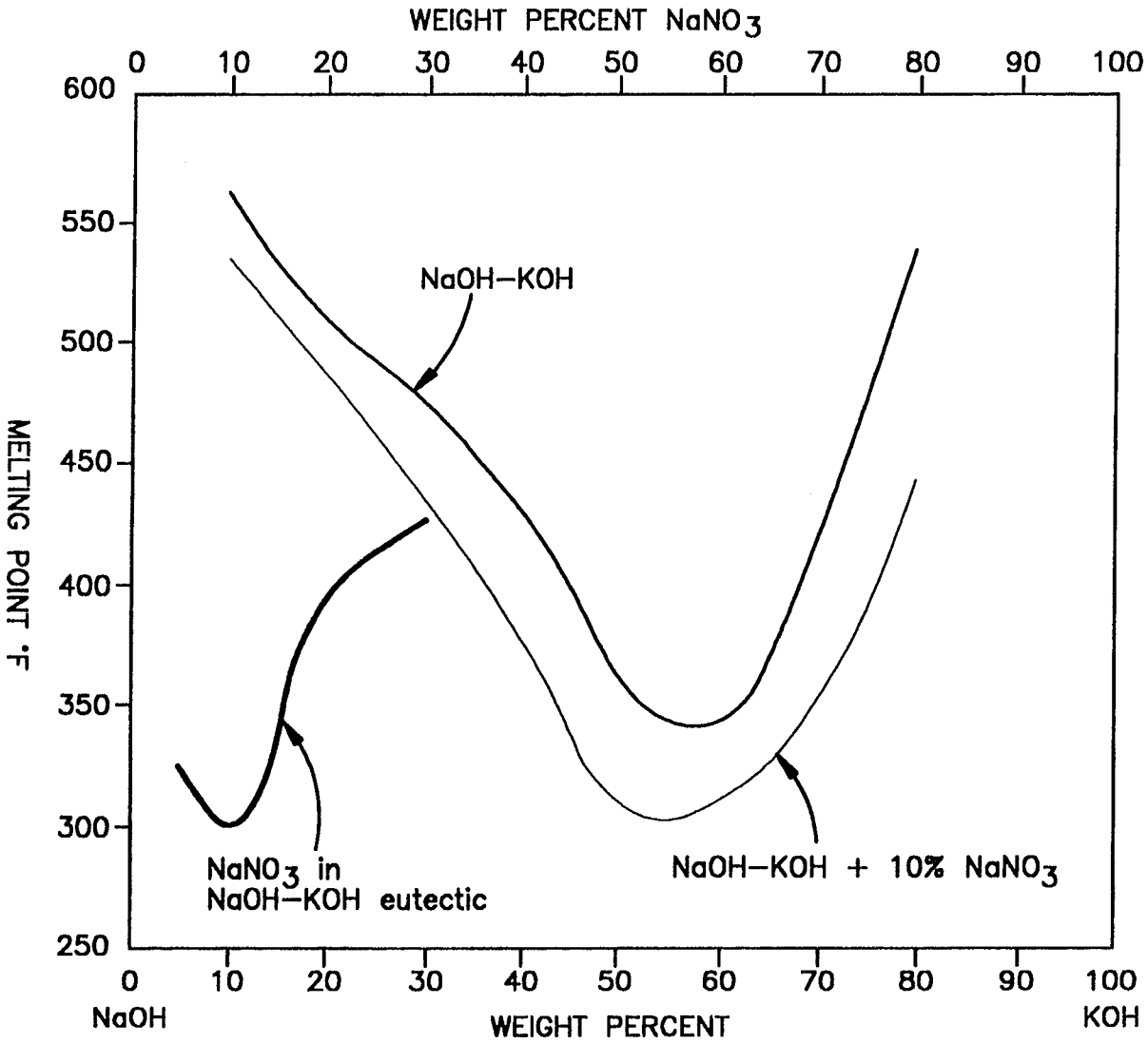
FIG. 5 is a graph showing the melting points of various anhydrous salt compositions.

Tests were also performed using various concentrations of KOH in the salt NaOH/KOH/$NaNO_3$, keeping the concentration of $NaNO_3$ constant at 10%. The KOH was added at levels of 10%, 30%, 53% (eutectic ratio), and 70% by weight. All panels were heated to either 1100° F. or 1200° F. and immersed in the salts at either 600° F. or 900° F. respectively for 1.5 seconds. The panels were then rinsed in water and pickled in 10% $H_2SO_4$ at 140° for 10 seconds and 15 seconds and 25 seconds, rinsed in water and dried. Descaling was acceptable on all the panels. It was noted that generally higher KOH levels improve the descaling performance somewhat; however this is not extremely significant at KOH levels above about 53% KOH. Moreover the slight improvement in performance of salts with KOH levels above about 53% is more than compensated for by the significant lowering of the melting point as shown in FIG. 5 with the decrease of NaOH. Thus the KOH/NaOH eutectic ratio with about 10% nitrate is preferred, since there is some degradation in performance with less than 10% nitrate.

It is also confirmed that the viscosity of the salt is a key and significant factor in performing efficient descaling. Very simply stated the lower the viscosity of the salt the less drag out there will be and hence the less loss of salt during operation which means less expense in salt usage. Table IV below shows the melting points of various salts Table V below shows the viscosity of various salts at temperatures. Table VI below shows the drag out at various salt temperatures of various salt compositions. FIG. 5 plots, in graphic form, the melting points of various salt compositions.

TABLE IV

Melting Points of Various Salts

| Salt: | | Temp: °F. |
|---|---|---|
| | % KOH: | |
| NaOH/KOH | 10 | 561 |
| | 20 | 509 |
| | 30 | 473 |
| | 40 | 428 |
| | 58 | 338 |
| | 70 | 419 |
| | 80 | 536 |
| | % KOH: | |
| NaOH/KOH + 10% $NaNO_3$ | 10 | 534 |
| | 20 | 485 |
| | 40 | 372 |
| | 53 | 300 |
| | 60 | 310 |
| | 70 | 350 |
| | 80 | 440 (phase separation occurred) |
| | % $NaNO_3$ | |
| NaOH/KOH Eutectic + $NaNO_3$ | 5 | 325 |
| | 10 | 300 |
| | 20 | 395 |
| | 30 | 425 |

TABLE V

MOLTEN SALT - VISCOSITY (cp)

| Salt: | MP (°F.): | Salt Temperature (°F.): 625 | 700 | 800 | 850 | 900 |
|---|---|---|---|---|---|---|
| DGS | 525 | 2.4 | 1.9 | 1.4 | 1.3 | 1.2 |
| K-6 | 394 | 1.3 | 1.2 | 1.1 | | |
| NaOH | 604 | | 3.3 | 2.4 | 2.2 | |
| KOH | 716 | | | 1.9 | 1.7 | 1.5 |
| NaNO3 | 586 | 2.7 | 2.2 | 1.7 | 1.5 | 1.4 |
| LN | 300 | 1.4 | 1.2 | 1.1 | 1 | 0.9 |
| NaOH/NaO3 65/35 | 496 | | | | | |

TABLE VI

MOLTEN SALT - DRAG-OUT
Grams of Salt per Sq. Inch of Panel

| Salt: | $Co_3$ % | Salt Temp. °F. 500 | 600 | 700 | 800 | 900 |
|---|---|---|---|---|---|---|
| DGS | 3.4 | | 0.0604 | 0.0496 | 0.0483 | 0.0396 |
| DGS | 26.8 | | | | 0.0646 | 0.05 |
| LN | 7 | 0.0621 | 0.0517 | 0.0450 | 0.0429 | 0.0375 |
| LN | 19.3 | | 0.0608 | 0.0517 | 0.0404* | 0.0479 |

TABLE VI-continued

MOLTEN SALT - DRAG-OUT
Grams of Salt per Sq. Inch of Panel

| Salt: | $Co_3$ % | Salt Temp. °F. 500 | 600 | 700 | 800 | 900 |
|---|---|---|---|---|---|---|
| K-6 | 4.7 | 0.0671 | 0.0571 | 0.0479 | 0.0438 | 0.0392 |

*Probable eval. error.
EACH EVALUATION IS THE AVERAGE OF FOUR SEPARATE TESTS.
(4" × 3" annealed 439 stainless steel panel = 24 sq. inches)

The salt with the eutectic ratio of sodium hydroxide and potassium hydroxide with about ten percent sodium nitrate has an extremely low melting point. Moreover, Table VI shows that at all comparable temperatures with DGS, sodium hydroxide and potassium hydroxide the drag out is significantly less with the salt of this invention. Indeed the drag out is even better than with K6 which is a more expensive salt composition and which has a higher melting point.

Tests were also performed descaling titanium. A salt composition of a eutectic ratio of KOH/NaOH and 10% $NaNO_3$ and DGS were each used at temperatures of 900° F., 1000° F. and 1100° F. to descale annealed titanium work pieces. With DGS at 900° there was no effect on the scale even after immersion for 10 seconds; at 1000° F. there was no significant descaling after 1 second, but there was descaling after 5 seconds; and even at 1100° F. descaling is not acceptable after 1 second, but only after 2 seconds. In contrast, the eutectic KOH/NaOH with 10% $NaNO_3$ was effective for descaling after 1 second at all temperatures, including 900° F. Thus, the salt of this invention is very effective for rapid descaling of metals other than stainless steel.

To summarize, in its broader aspects, the salt of this invention contains from about 40% and to about 70% KOH. With less than 40% KOH the effectiveness of the descaling action is sharply curtailed, and also the viscosity increases dramatically. Likewise there should be from about 20% and about 55% sodium hydroxide. More than 55% sodium hydroxide lowers the amount of potassium hydroxide which can be present, and less than 20% increases the viscosity dramatically. There should be from about 2% and about 30% of an alkali metal nitrate. With less than about 2%, the effectiveness of descaling is sharply curtailed, and with more than about 30%, the viscosity is significantly increased with no significant increase in effectiveness. Within this broad range, the more preferred ranges are from about 45% and about 60% potassium hydroxide, from about 25% and about 45% sodium hydroxide, are from about 6% and about 20% of an alkali metal nitrate. The most preferred composition is a eutectic ratio of NaOH/KOH with about 10% alkali metal nitrate, preferably sodium nitrate. This provides the optimum descaling effectiveness and viscosity.

SALT SPRAYING

The above types of salt are sprayed through the nozzles in molten droplets. However, as described previously, these salts can also be applied from the spray chamber as a continuous stream impinging directly on the metal strip.

Finally, a minimum quantity of salt is necessary for descaling of the hot metal strip. It has been determined that for an effective reaction, preferably at least 50 grams of descaling salt per square meter of surface should be sprayed on the strip.

When the descaling salt is applied to the metal strip using the parameters described above, efficient, rapid and effective descaling of the strip is achieved. As indicated previously, the present invention is also applicable to metal strip, bars, tubing or other forms made from titanium, nickel or cobalt based alloys. The reaction time, strip and salt temperature and quantity of salt can vary slightly with these other alloys, however, these parameters are easily determined by simple experimentation which are well within the level of skill of those knowledgeable in the art.

POST SALT TREATMENT

After the metal strip passes through the spray area 35 and the molten salt is applied to the metal strip, the strip enters the steam wipe area 37 (FIGS. 1–3). The steam wipe area 37 includes an array of steam nozzles which are directed downwardly toward the upper surface, and an array of steam nozzles which are directed upwardly toward the lower surface of the metal strip, to remove the excess molten salt if necessary after the descaling reaction has occurred. The upper and lower arrays of steam nozzles direct steam at approximately 225° F. (107° C.) to 900° F. (482° C.) at a pressure of 15 to 40 pounds per square inch against the upper and lower surfaces of the steel strip to distribute and remove the excess salt.

The steam nozzle arrays include a first set of upper steam headers 100A, 100B which are fluidly connected to a steam inlet 102 (FIG. 2) by piping 103. The headers 100A, 100B include nozzles, indicated generally at 104A in FIG. 1, which direct the steam from inlet 102 downwardly on the upper surface of the metal strip. A similar set of lower steam headers 100C, 100D having nozzles 104B are also connected to steam inlet 102 and direct steam upwardly toward the lower surface of the metal strip at approximately the same location in the line as the upper steam headers 100A, 100B. Brackets 105A, 105B, and 105C, 105D (FIG. 2) mount the headers 100A, 100B and 100C, 100D respectively, to the inside surface of the spray chamber.

Similarly, a second and third set of upper steam headers 106A, 106B and 107A, 107B are mounted downstream of the first steam headers 100A, 100B to apply steam downwardly through nozzles 108A, 108B against the upper surface of the strip. Similar sets of lower steam headers 106C, 106D and 107C, 107D are also provided to apply steam upwardly through nozzles 108B, 109B, respectively, against the lower surface of the metal strip at approximately the same location in the line as the upper steam headers. The second and third sets of headers are also fluidly connected to the steam inlet 102 by piping 103 and include mounting brackets 112A, 112B, and 113A, 113B, respectively, to mount these headers to the inside surface of the spray box.

The first, second and third sets of headers are preferably mounted in a "V"-shaped arrangement to apply the steam downwardly and outwardly (and upwardly and outwardly) respectively against the upper and lower surfaces of the metal strip respectively. The V-shaped arrangement facilitates coating the metal strip with the molten descaling salt as the steam "pushes" the salt backward on the strip as the strip travels through the spray box. In particular, the first set of upper and lower headers primarily provide salt distribution across the strip, while the second or third sets of upper and lower headers primarily push the salt off the metal strip.

This action of pushing the salt across the strip is particularly important in effectively descaling the strip should one of the salt spray nozzles in the upper or lower pair of nozzles become clogged. In this case, the headers will spread the salt across the strip to completely cover the strip regardless of the clogged nozzle. For faster metal processing speeds, the steam headers can be mounted further downstream of the spray area so that the reaction time for the salt on the metal strip is maintained within the appropriate parameters described previously.

The steam headers described above, and in particular the second and third steam headers, push the salt off the metal strip and into a catch basin or pan 120 (FIG. 3) located beneath the strip. The catch basin extends across the width of the spray box and is mounted at an angle thereto to direct the salt into the salt furnace 74 for re-use, if desired. It should be apparent that the spray chamber should be mounted higher than the salt furnace for this draining to be achieved during and after the spray process. Alternatively, the salt can run to a drain for treatment, recycling or disposal to prevent the reacted salt from mixing with fresh salt.

After the steam wipes have been applied to the strip, the strip enters the rinse area 39. The rinse area 39 includes upper and lower pairs of spray nozzles 138A, 138B, which direct water toward the upper and lower surfaces, respectively, of the metal strip. The water nozzles rinse any remaining salt off the strip that was not previously removed in the steam wipe area. The rinse area also includes upper and lower pairs of air blow-off headers 142A, 142B, which can include nozzles (not numbered) and can be shaped in a V-arrangement and direct air toward the upper and lower surfaces of the strip, respectively, to dry the strip before the strip leaves the rinse area. Excess water is collected by angled catch basin 130 and drains out through outlet piping 146.

Upon exiting the rinse area, the strip exits the spray box and is further processed e.g., in a pickling tank of 10% sulfuric acid at 130° F. (54° C.); rinsed in water; immersed in 12% nitric acid and 2% HF acid at 120° F. (49° C.); and finally rinsed again in water and dried. Other acid combinations may be used, as is known to those skilled in the art.

To operate the spray descaling system, the heater is initially activated to bring the temperature of the spray chamber and nozzles above the melting point of the salt for a predetermined period of time. Molten salt from the furnace is then pumped into the spray chamber and applied to the strip through the nozzles. Excess salt is forced off the strip by the steam wipe, and ordinarily drains back into the salt furnace for re-use. Finally, the strip is rinsed and dried in the rinse area and passes out of the spray box for further processing. When the spraying is complete, the immersion pump is deactivated and the salt is allowed to drain out of the nozzles and the spray chamber and back into the salt furnace before the heater in the spray chamber is deactivated. In this manner, salt freezing on the sides of the spray chamber and in the nozzles is prevented.

Tests have been conducted using stainless steel having an oxide layer thereon. For example, Type 304 stainless steel which was 37 inches wide and 0.04 inches thick, was run through the above-described spray descaling system at 34 feet per minute (10.4 meters per minute) with satisfactory results wherein the scale was removed and a bright, high corrosion resistant surface was provided. Additionally, type 304 stainless steel, 32 inches wide and 0.081 inches thick, was run through the spray descaling system at 30 feet per minute (9 meters per minute) also with satisfactory results. Further, type 304 stainless steel, 37-inch wide and 0.04 inches thick, was run through at 50 feet per minute (15 meters per minute).

Accordingly, as described above, the present invention provides a new and useful spray descaling system for an annealing line of a production facility. The system is effective and efficient in descaling metal strip after the strip emerges from an annealing furnace, and prior to pickling in an acid bath. The present invention provides nozzles mounted to a self-contained nozzle assembly which can be easily attached to and removed from the spray descaling system, inspected, and the nozzles and other associated components repaired or replaced if necessary.

Although the invention has been described with respect to a certain preferred embodiment, it is obvious that equivalent alterations and modifications will occur to those skilled in the art upon their reading and understanding of the specification. For example, annealing conditions, atmosphere and strip speed can have some effect on the time, strip and salt temperatures and salt quantity necessary to provide an effective and efficient salt descaling system.

The salt described above is especially adapted for use in spray descaling as described above. However, it may also be used in conventional salt bath installations wherein the salt is maintained in a fused condition in a tank, and the metal strip, bars, tubing or other shapes are immersed in the bath.

The present invention includes all such equivalent alterations and modifications, and is only limited by the scope of the following claims.

What is claimed is:

1. A method of descaling a metal having a surface layer of oxide scale thereon comprising the steps providing a metal article with scale thereon, providing a fused essentially anhydrous salt comprising by weight;

from about 40% to about 70% potassium hydroxide;

from about 20% to about 55% sodium hydroxide; and from about 2% to about 30% of an alkali metal nitrate; and contacting the scaled surface of the metal with said fused salt for conditioning and partially removing the scale; and thereafter contacting the scaled surface of the metal with acid to completely remove the scale from the surface of the metal.

2. The invention as defined in claim 1 wherein there is;

from about 45% to about 60% potassium hydroxide;

from about 25% to about 45% sodium hydroxide; and from about 6% to about 20% of an alkali metal nitrate.

3. The invention as defined in claim 2 wherein the salt is maintained at a temperature between about 500° F. and 1200° F.

4. The invention as defined in claim 3 wherein the salt contacts the scale between 1 and 5 seconds.

5. The invention as defined in claim 2 wherein the fused salt is sprayed onto the scale on the metal.

6. The invention as defined in claim 5 wherein the metal is moved during spraying.

* * * * *